United States Patent [19]

Alexander et al.

[11] Patent Number: 4,845,971

[45] Date of Patent: Jul. 11, 1989

[54] STRAP WINDING DISPOSAL DEVICE

[75] Inventors: Edward Roder; Gregory Napper, both of Victoria, Australia

[73] Assignee: Australian Wool Corporation, Victoria, Australia

[21] Appl. No.: 194,514

[22] Filed: May 16, 1988

[30] Foreign Application Priority Data

May 15, 1987 [AU] Australia ..... PI1986

[51] Int. Cl.[4] ..... B21C 47/00; B21D 5/14

[52] U.S. Cl. ..... 72/146; 72/169; 72/171; 72/172

[58] Field of Search ..... 72/146, 147, 148, 166, 72/169, 171, 172, 173, 174

[56] References Cited

U.S. PATENT DOCUMENTS

| | | | |
|---|---|---|---|
| 884,314 | 4/1908 | Carpenter | 72/146 |
| 1,804,468 | 5/1931 | Jensen | 72/171 |
| 2,179,011 | 11/1939 | Hudson | 242/78.1 |
| 2,335,028 | 11/1943 | Rose et al. | 72/173 X |
| 2,387,688 | 10/1945 | Spahr | 72/171 |
| 2,675,849 | 4/1954 | Greenshields et al. | 72/171 |
| 2,937,821 | 5/1960 | O'Brien | 242/78.1 |
| 3,303,679 | 2/1967 | Cavagnero | 72/35 |
| 3,438,406 | 4/1969 | Rozmus | 140/93.2 |
| 4,549,422 | 10/1985 | Harrow | 72/171 X |
| 4,633,698 | 1/1987 | Oetiker | 72/171 X |
| 4,726,210 | 2/1988 | Weil et al. | 72/173 X |

FOREIGN PATENT DOCUMENTS

| | | | |
|---|---|---|---|
| 381445 | 5/1973 | U.S.S.R. | 72/173 |
| 435987 | 7/1974 | U.S.S.R. . | |

*Primary Examiner*—E. Michael Combs
*Attorney, Agent, or Firm*—Nixon & Vanderhye

[57] ABSTRACT

A strap coiling mechanism comprising a driven roller one having a serrated peripheral surface, a pinch roller for rotatably mounted at one extremity of a pivoted crank lever 8, said pinch roller being biassed towards the driven roller 1 by means of a compression spring 6 engaging the other end of the crank lever 8 and part of the supporting frame for the mechanism. The driven roller 1 and the pinch roller 4 between them define a nip N into which strapping S to be coiled is introduced. In the event that the strapping includes a Seal' or any other section modulus change, a pinch roller 4 will be deflected away from the driven roller 1 against the action of the spring 6 to allow the seal to pass through the nip N. A deforming roller 3 is rotatably mounted immediately behind the Nip and has a serrated peripheral surface which is engaged by the strapping S to form the strapping into a shelf closing coil C.

10 Claims, 3 Drawing Sheets

STRAP WINDING DISPOSAL DEVICE

FIELD OF THE INVENTION

This invention relates to metal strap handling and disposal.

BACKGROUND OF THE INVENTION

Steel strapping is widely used for packaging by many industries including: aluminium, brick, cotton, jute, man-made fibres and wool. Disposal of strap material used in such industries is a major materials handling problem in terms of the collection, storage and disposable of such strap material.

Strapping is presently disposed of by placing it in waste bins and the like. Used or waste strapping invariably occupies far more space than its own volume and it is difficult to compress without the use of special compacting equipment. It is also difficult and dangerous to handle due to its springy nature.

BRIEF SUMMARY OF THE INVENTION

It is the object of the present invention to provide a used strap coiling mechanism which will result in the alleviation of the disposal problems referred to above.

The invention therefore provides a metal strap coiling device comprising a driven roller and a pinch roller biased towards each other by biasing means to define a nip between said rollers into which the strapping to be coiled is introduced, deforming means positioned behind the nip between said rollers for inducing the strapping to form a self-closing coil, said biasing means including means which enables the nip between said rollers to be enlarged against the action of said biasing means to facilitate the passage of section modulus changes which, for example, occur when strapping seals, deformed portions of the strap or the like pass between said rollers.

In one form of the invention, the pinch roller is rotatably mounted on a pivoted arm which is biased by said biasing means towards said driven roller to define said nip. Although it is less convenient, it will be appreciated that the driven roller may be mounted on a pivoted assembly and biased towards the pinch roller to achieve the same end.

The deforming means preferably comprises a further roller which is driven at the same surface speed as the driven roller. In a preferred form of the invention, said driven roller is serrated to minimize slipping between said strapping and said nip rollers.

One of the more difficult problems encountered in coiling strapping having applied seals is the deformation of the short strapping element which projects from the seal. Unless this element is properly deformed, the strapping will not coil properly and the strapping will not feed through the coiling device. For this reason the deforming roller is also preferably serrated to engage and deform the strap projections in the area of the seal to allow better formation of a coil of said strapping.

In a particularly preferred form of the invention, the deforming roller is mounted on means which pivots about the axis of rotation of said driven roller, said means being linked to said pivoted assembly so that said deforming roller is pivoted with said pinch roller when section modulus changes are encountered.

The strap coiling mechanism preferably includes a curved deflector bar which serves to guide the leading edge of the deformed strapping during initial formation of the self-closing coil.

The mechanism is preferably mounted on an elevated frame so that a storage container or drum may be located below the coiling region of the mechanism.

BRIEF DESCRIPTION OF THE DRAWINGS

One preferred form of the invention will now be described with reference to the accompanying drawings in which.

DESCRIPTION OF THE PREFERRED EMBODIMENTS

Figure 1:
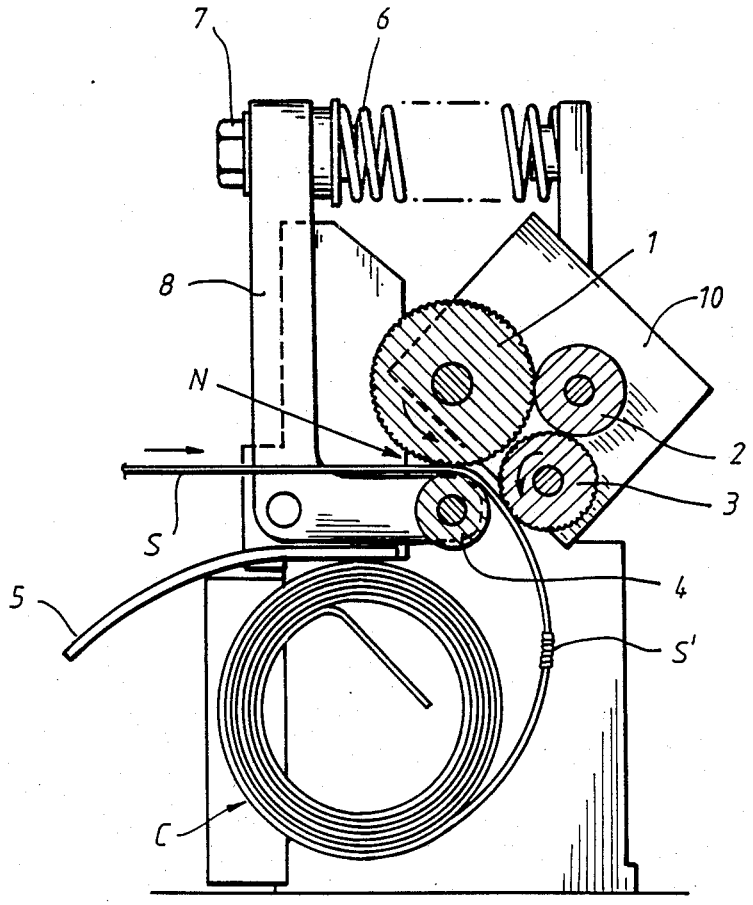
FIG. 1 is a sectional side view of the strap coiling mechanism embodying the invention.

Referring firstly to FIG. 1 of the drawings, the strap coiling mechanism will be seen to comprise a driven roller 1 having a serrated peripheral surface (FIG. 2), a pinch roller 4 rotatably mounted at one extremity of a pivoted crank lever 8, the pinch roller 4 being biased towards the driven roller 1 by means of a compression spring 6 engaging the other end of the lever 8, the biasing force being adjustable by means of an adjusting screw 7. A nip N is defined between the driven roller 1 and the pinch roller 4 and the nip N receives strapping S to be coiled. In the event that the strapping includes a seal S′ or other similar connecting device, the pinch roller 4 will be deflected away from the driven roller 1, against the action of the spring 6, to allow the passage of the seal S′ through the nip N.

A deforming roller 3 is rotatably mounted between a pair of side plates 10 which are pivoted about the axis of the driven roller 1. The roller 3 is located behind the nip N in a position which causes the strapping S to engage the serrated surface of the deforming roller 3 to induce the strapping S to form a self closing coil C. A curved deflector bar 5 is located in a position to guide the leading edge of the deformed strapping S during the initial formation of the coil C.

The deforming roller 3 is driven at the same surface speed as the driven roller 1 by means of an idler gear 2, mounted on the rearmost plate 10 and which meshes with gears attached to the shafts supporting the driven roller 1 and the deforming roller 3 and defining gear train G.

Figure 2:
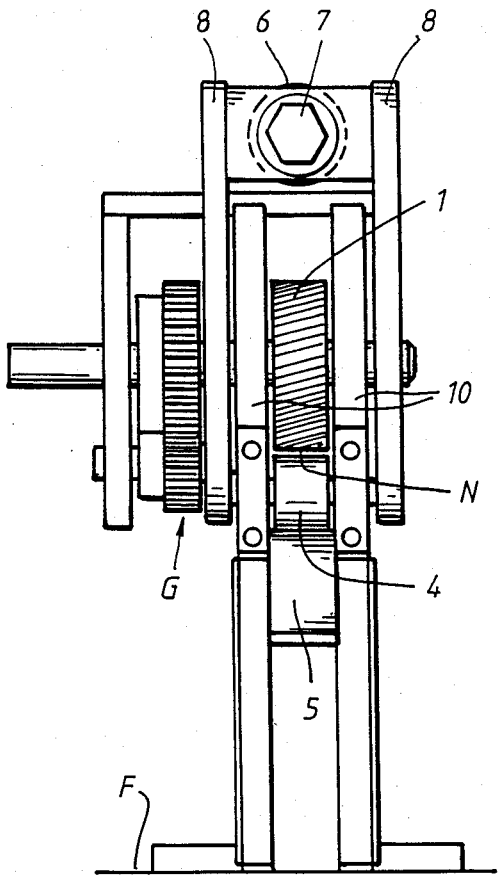
FIG. 2 is a front elevation of the strap coiling mechanism of FIG. 1.
Figure 3:
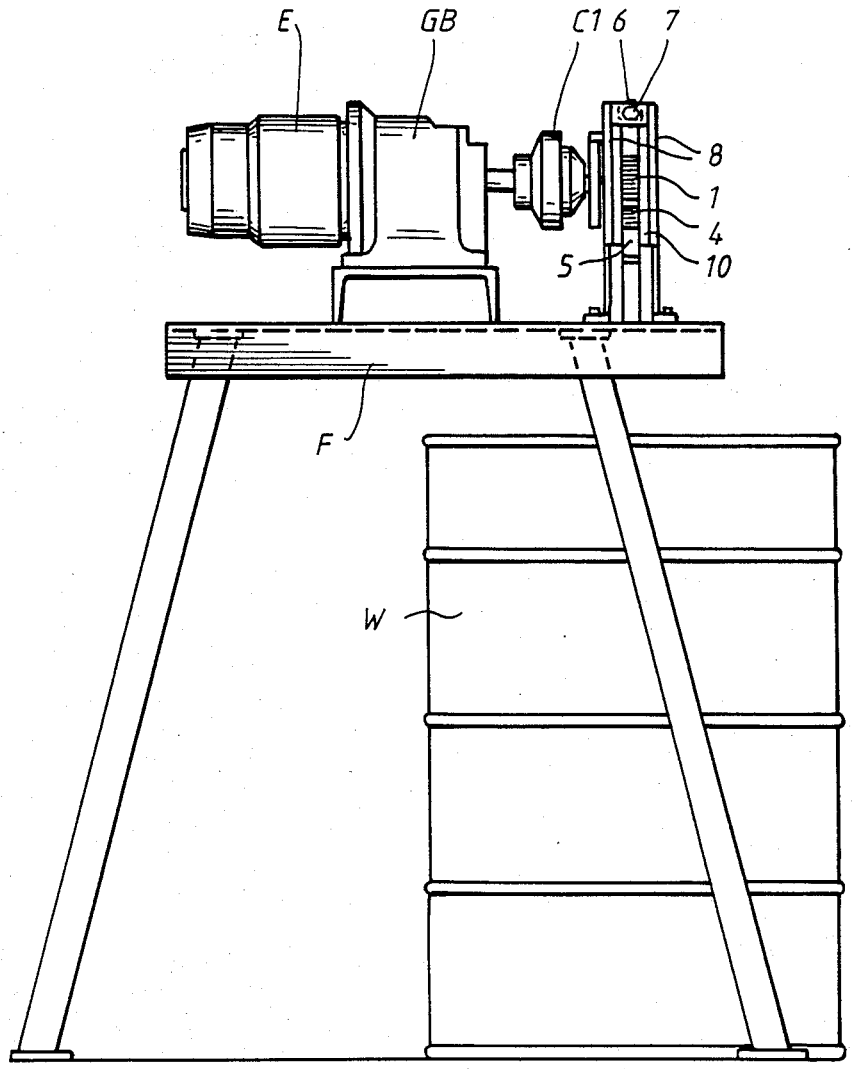
FIG. 3 is a side elevation of the mechanism in use.

The strap coiling mechanism is driven by an electric motor E through a gearbox G and a clutch C1. As shown in FIG. 2 of the drawings, the driven roller 1 and the deforming roller 3 are supported in bearings carried in supporting side plates P while the pinch roller 4 is carried in bearings mounted at the ends of the crank arms 8.

The strap coiling mechanism is preferably mounted on an elevated frame F so that a waste container W may be positioned below the exit region for the coil C when the end of the strapping S is reached. It will be appreciated that a closed coil of strapping such as that shown in FIG. 1 of the drawings will occupy far less volume within the waste container W than an uncoiled length of strapping.

While in the above embodiments a deforming roller is used to induce a self-closing coil of strapping S, any suitable deforming means may be used to achieved a similar end. However, the use of a serrated surface deforming roller is preferred since it more positively engages the seal area during the formation of the self-closing coil in the strapping S. Similarly, while the pinch roller 4 has been shown as being deflectable to allow the passage of strapping seals S', similar results may be achieved by spring biasing the driven roller 1 for pivotable or vertical movement with respect to the pinch roller 4.

We claim:

1. A metal strap coiling device comprising a driven roller and a pinch roller biassed towards each other by biassing means to define a nip between said driven and pinch rollers into which the strapping to be coiled is introduced; deforming means positioned behind the nip between said rollers for inducing the strapping to form a self-closing coil with multiple wraps, said deforming means comprising a further roller means for driving said driven and said further rollers about the same surface speed, said further roller having surface gripping means to minimize slippage when engaging the strapping; said biassing means including means which enables the nip between said driven and pinch rollers to be enlarged against the action of said biassing means to facilitate the passage of section modulus changes which occur when strapping seals, deformed portions of the strap or the like pass between said rollers; and means remote from said rollers for facilitating formation of a self-closing coil of metal strap with multiple wraps.

2. The device of claim 1, wherein said pinch roller is rotatably mounted on a pivoted arm which is biassed by said biassing means towards said driven roller to define said nip.

3. The device of claim 1, wherein said driven roller further provided with surface gripping means comprising a serrated peripheral surface to minimize slipping between the strapping and the nip rollers.

4. The device of claim 1, wherein said deforming roller is mounted on means which pivots about the axis of rotation of said driven roller, said means being linked to said pivoted arm so that said deforming roller is pivoted with said pinch roller when section modulus changes are encountered.

5. The device of claim 1, wherein said means for facilitating formation of a self-closing coil of strapping includes a stationary curved deflector bar positioned to guide the leading edge of the deformed strapping during the initial formation of the self-closing coil.

6. The device of claim 4 wherein said means for facilitating formation of a self-closing coil of strapping includes a stationary curved deflector bar positioned to guide the leading edge of the deformed strapping during the initial formation of the self-closing coil.

7. A metal strap coiling means comprising a driven roller, a pinch roller rotatably mounted at one end of a crank lever pivotally mounted on a frame supporting said driven roller, biassing means supported by said frame and engaging an end of said crank lever opposite said one end to bias said pinch roller towards said driven roller, a deforming roller rotatably mounted behind the nip between said driven roller and said pinch roller and positioned to engage the strapping fed from said nip into a multiple wrap self-closing coil, means for driving said driven and said deforming rollers at substantially the same surface speed.

8. The device of claim 7, wherein said driven roller and said deforming roller have serrated peripheral surfaces to minimize slipping between the strapping and said driven and deforming rollers.

9. A metal strap coiling means as recited in claim 7, further comprising a stationary curved deflector bar positioned to guide the leading edge of the deformed strapping during the initial formation of the self-closing coil.

10. A metal strap coiling means as recited in claim 8, further comprising a stationary curved deflector bar positioned to guide the leading edge of the deformed strapping during the initial formation of the self-closing coil.

* * * * *